US007063522B1

(12) United States Patent
Sun

(10) Patent No.: US 7,063,522 B1
(45) Date of Patent: Jun. 20, 2006

(54) SCROLL COMPRESSOR WITH COMPLEX FILLETS BETWEEN ECCENTRIC PIN AND SHAFT SHOULDER

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 11/010,933

(22) Filed: Dec. 13, 2004

(51) Int. Cl.
*F04C 18/04* (2006.01)

(52) U.S. Cl. ..... 418/55.5; 418/55.1; 418/57; 74/570.1

(58) Field of Classification Search ..... 418/55.1–55.5, 418/57; 74/570.1
See application file for complete search history.

(56) References Cited

U.S. PATENT DOCUMENTS 5,496,158 A * 3/1996 Barito et al. ..... 418/55.5
6,361,297 B1 * 3/2002 Hugenroth ..... 418/55.5
6,428,294 B1 * 8/2002 Fenocchi ..... 418/55.5
6,585,502 B1 * 7/2003 Fenocchi ..... 418/55.5

* cited by examiner

*Primary Examiner*—Theresa Trieu
(74) *Attorney, Agent, or Firm*—Carlson, Gaskey & Olds

(57) ABSTRACT

A scroll compressor has an eccentric pin that extends forwardly of a rotating shaft. The eccentric pin generally has a curved outer portion and a flat outer portion. Each of the flat and curved outer portions have fillets that are formed to merge the eccentric pin portions into an end surface or shoulder on the shaft. The fillets are formed to have a relatively complex shape with more than a single radius of curvature. In one embodiment, there are two radii of curvature, with a greater radius of curvature formed to extend from an outer periphery of the eccentric pin, and merge into a second portion having the lesser radius of curvature that merges from the first portion downwardly into the shoulder. In a second embodiment, the fillet generally has the shape of one quarter of an ellipse.

7 Claims, 3 Drawing Sheets

SCROLL COMPRESSOR WITH COMPLEX FILLETS BETWEEN ECCENTRIC PIN AND SHAFT SHOULDER

BACKGROUND OF THE INVENTION

This application relates to a scroll compressor wherein an eccentric pin extending forwardly of a rotating shaft shoulder is formed to have fillets at its roots that have a complex shape, to reduce the likelihood of fatigue.

Scroll compressors are becoming widely utilized in refrigerant compression applications. In a scroll compressor, a pair of scroll members each have a base with a generally spiral wrap extending from the bases. One of the two scroll members is caused to orbit relative to the other.

In one major style of scroll compressors, the one scroll member is caused to orbit by a rotating shaft being driven by an electric motor. The rotating shaft has a pin formed to extend eccentrically from an end of the shaft, and into a boss in the one scroll member. A slider block is positioned between the eccentric pin and the boss. Rotation of the shaft causes an orbiting movement of the one scroll member through the interaction of the eccentric pin and the slider block.

In the prior art, the surface between the eccentric pin and an end of the shaft, or the shaft shoulder, has fillets formed along a single radius. The eccentric pin has generally had a relatively flat surface that engages a surface in the slider block, and a circular surface extending between circumferential ends of the flat surface. There have been distinct fillets at both the circular portion and in the flat portion, however, both fillets have been formed along a single radius.

Due to size issues, the fillets have not been able to be as large as may be desirable. Because of this, the ends or tangent portions of the fillets, are relatively close to the shaft shoulder. As the forces encountered by the eccentric pin in causing the one scroll member increase, such as may be the case with increasing capacity for the scroll compressor, there is a greater likelihood of fatigue of the eccentric pin. While these issues could be addressed by increasing the size of the eccentric pin, or simply increasing the radius of the fillet, such changes would require an increase in the size of the scroll compressor. A size increase would be undesirable.

SUMMARY OF THE INVENTION

In a disclosed embodiment of this invention, the fillet between the eccentric pin and the shaft shoulder at both the curved portion and the flat portion is formed to be more complex than a single radius. In one embodiment, a pair of radii are utilized with a larger radius merging into the outer diameter of the eccentric pin, and a smaller radius connecting from the larger radius and merging into the shaft shoulder. A pair of radii are utilized at both the flat surface, and at the curved portion. With this invention, a larger radius is provided at a high stress portion adjacent the outer periphery of the eccentric pin, while the smaller radius portion ensures that the eccentric pin, and the shaft, need not be formed to have a greater diameter.

In another embodiment, the complex surface is formed by an ellipse, such that varying radii are provided along the fillet.

These and other features of the present invention can be best understood from the following specification and drawings, the following of which is a brief description.

DETAILED DESCRIPTION OF THE PREFERRED EMBODIMENT

Figure 1:
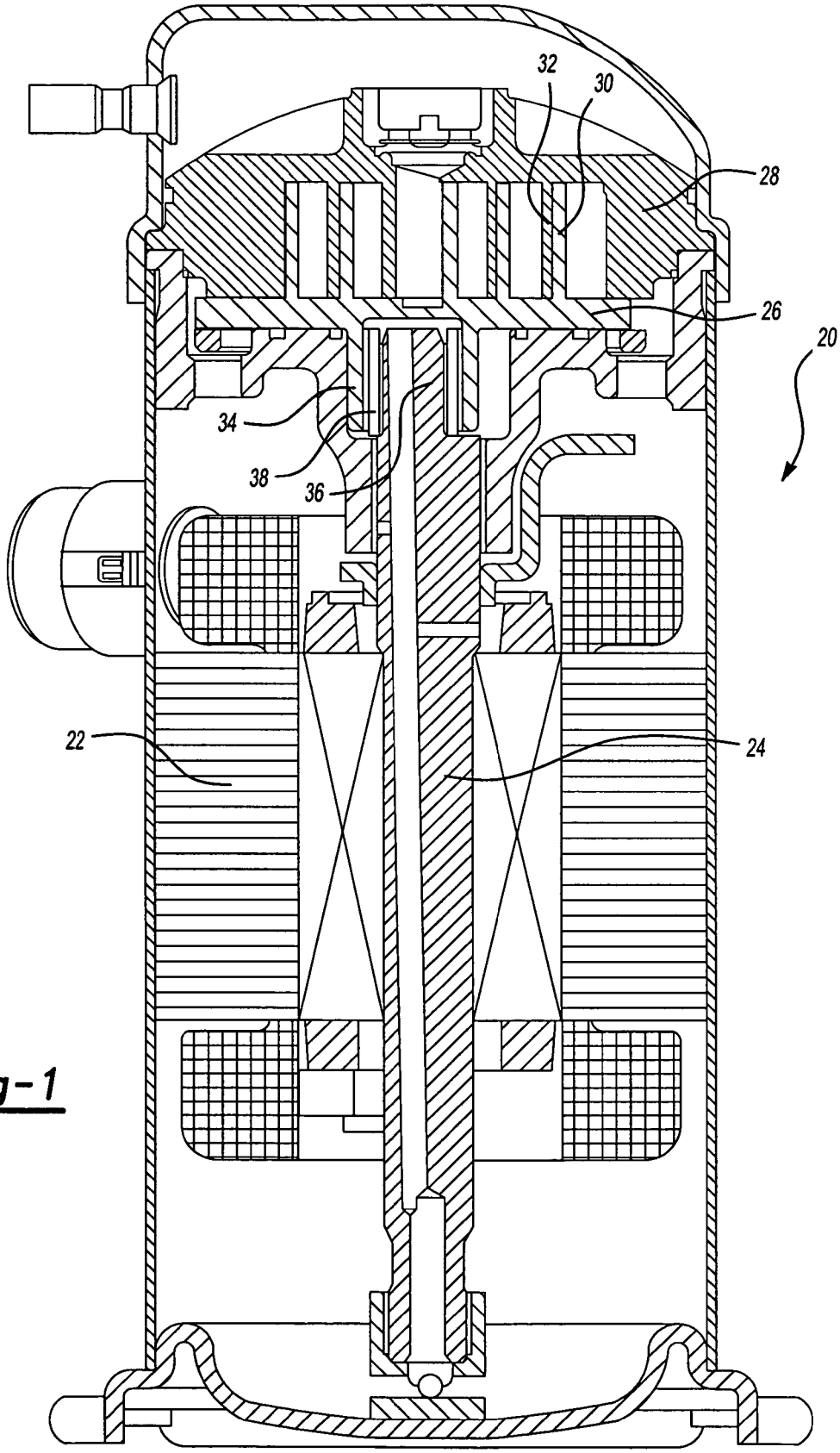
FIG. 1 shows a scroll compressor incorporating the present invention.

A scroll compressor 20 is illustrated in FIG. 1 having an electric motor 22 for causing a shaft 24 to rotate. As known, an orbiting scroll 26 interfits with a non-orbiting scroll 28. Orbiting scroll 26 carries a generally spiral wrap 30, and non-orbiting scroll 28 carries a generally spiral wrap 32. The wraps interfit to define compression chambers that are reduced in volume as the orbiting scroll 26 is caused to orbit. As known, a boss 34 extends downwardly from the orbiting scroll 26 and receives an eccentric pin 36 extending forwardly of the shaft 24. A slider block 38 sits between the eccentric pin 36 an the boss 34.

Figure 2:
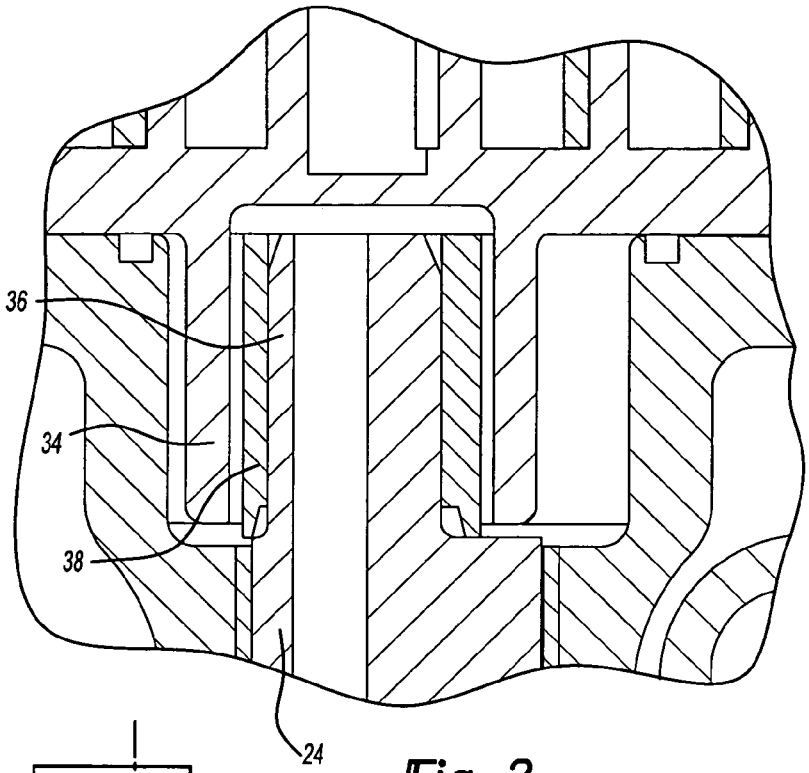
FIG. 2 is a cross-sectional view through a portion of the FIG. 1 scroll compressor.

As shown in FIG. 2, the shaft 24 has the eccentric pin 36 extending upwardly into the slider block 38, and received within the boss 34. As known, flat surfaces on the eccentric pin 36 and the slider block 38 interfit to define a thrust surface for causing movement of the orbiting scroll 26 when the shaft 24 rotates.

Figure 3A:
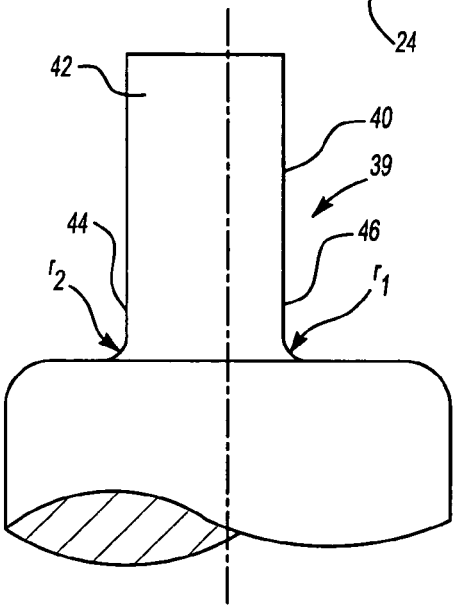
Fig-3A PRIOR ART
FIG. 3A shows a prior art shaft and eccentric pin.
Figure 3B:
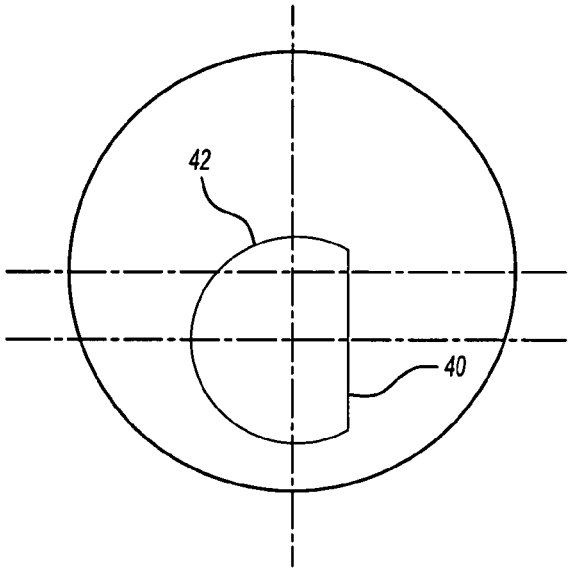
Fig-3B PRIOR ART
FIG. 3B is a top view of the FIG. 3A prior art.

FIG. 3A shows a prior art eccentric pin 39 that has a generally curved portion 42 having a fillet 44, and a generally flat portion 40 having a fillet 46. FIG. 3B shows the flat portion 40 and the curved portion 42.

As can be appreciated from FIG. 3A, the fillet 46 and the fillet 44 are both formed to have a single radius of curvature, and thus have the problem as described above.

Figure 4A:
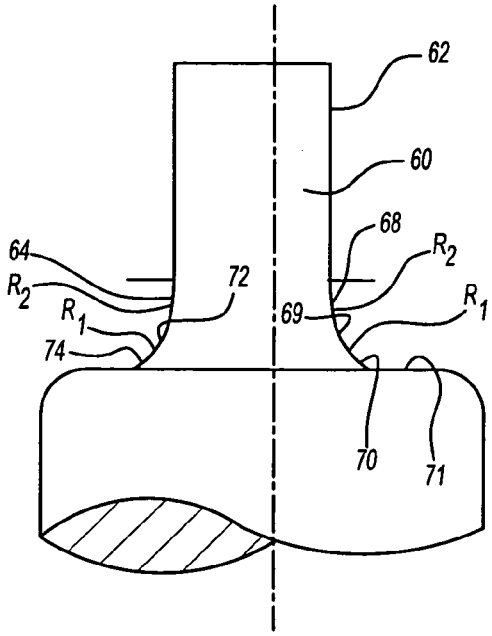
FIG. 4A shows an inventive shaft and eccentric pin.
Figure 4B:
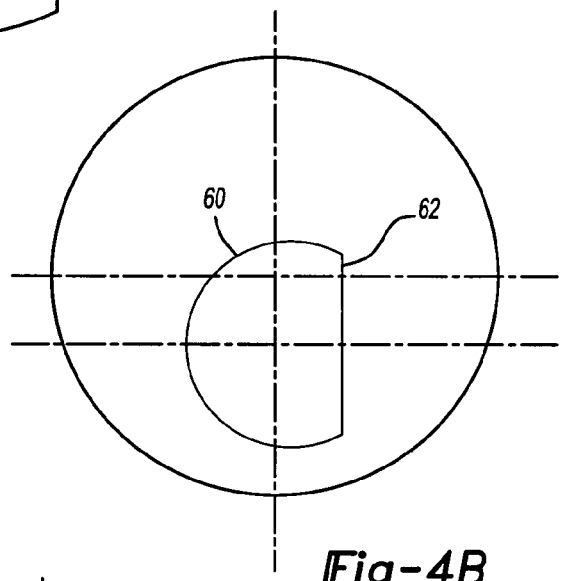
FIG. 4B is a top view of the FIG. 4A embodiment.

FIGS. 4A and 4B show a first embodiment eccentric pin 60, wherein the flat portion 62 has a fillet formed of a compound surface with a first relatively large radius portion 68($R_2$) extending to an outer surface of the eccentric pin 60, and a second relatively small radius portion 70($R_1$) extending to a shoulder 71 of the shaft. A merge point 69 blends the two portions.

The curved portion 64 has similar portions 64 and 74 extending to the shoulder 71. A merge point 72 blends the two portions.

In preferred embodiments, the radius for portion 68, portion 70, portion 72, and portion 74 may be as shown. Of course, other radii may be utilized within the scope of this invention.

Figure 5:
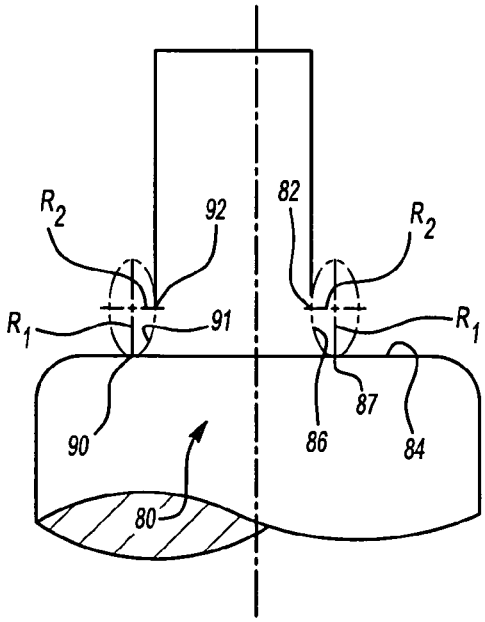
FIG. 5 shows a second embodiment shaft and eccentric pin.

FIG. 5 shows another embodiment 80 wherein the fillets are formed to generally have the shape of an ellipse, such that there is a relatively large radius portion 82 at one end and a decreasing radius portion 86 extending to a relatively smaller radius portion 87 extending to the shoulder 84, and similar portions 90, 91 and 92 on the curved portion.

The present invention thus provides an eccentric pin extending from a shaft in a scroll compressor that is less likely to suffer from fatigue, but which does not require any dimensional changes in the sizes of the shaft, eccentric pin, slider block, or the orbiting scroll.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from said base, said wraps of said first and second scroll members interfitting to define compression chambers;

a shaft driven to rotate by an electric motor, said shaft extending upwardly to cause said second scroll member to orbit relative to said first scroll member, said shaft having an eccentric pin extending upwardly into a slider block, said slider block received within a boss extending rearwardly from said base of said second scroll member, and said eccentric pin having a curved portion over a portion of an outer circumference of said eccentric pin and a generally flat portion over another portion of said circumference of said eccentric pin, with said curved portion and said generally flat portion extending upwardly from an end shoulder of said shaft, with fillets defined between said generally flat portion and said end shoulder, and said curved portion and said end shoulder, with at least one of said fillets having a complex shape with more than one radius of curvature.

2. The scroll compressor as recited in claim 1, wherein both said fillets has a complex shape with more than one radius of curvature.

3. The scroll compressor as recited in claim 2, wherein each of said fillets have a greater radius of curvature over a first portion formed to extend from an outer periphery of said eccentric pin downwardly towards a second portion having a lesser radius of curvature, with said second portion extending from said first portion to merge with said end shoulder.

4. The scroll compressor as recited in claim 2, wherein said fillets generally have the shape of a quarter of an ellipse.

5. The scroll compressor as recited in claim 1, wherein said at least one of said fillets has at least two radii of curvature, with a greater radius of curvature over a first portion formed to extend from an outer periphery of said eccentric pin downwardly toward a second portion having a lesser radius of curvature, with said second portion extending from said first portion to merge with said end shoulder.

6. The scroll compressor as recited in claim 1, wherein said curved portion is generally part-cylindrical beyond said fillet.

7. The scroll compressor as recited in claim 1, wherein said complex shape has a greater radius of curvature at a first location than at the radius of curvature at a second location, with said second location being spaced toward said end shoulder relative to said first location.

* * * * *